US012601349B2

(12) United States Patent
Del-Valle et al.

(10) Patent No.: US 12,601,349 B2
(45) Date of Patent: Apr. 14, 2026

(54) COMPRESSOR

(71) Applicant: VALEO JAPAN CO., LTD., Kumagaya (JP)

(72) Inventors: Edward Del-Valle, Auburn Hills, MI (US); Imed Guitari, La Verriere (FR); Karthikeyan Rajendran, Chennai (IN); Satish Saga, Chennai (IN); Mohamed-Thasthagir Mohamed-Hashim, Chennai (IN)

(73) Assignee: Valeo Japan Co., Ltd., Kumagaya (JP)

( * ) Notice: Subject to any disclaimer, the term of this patent is extended or adjusted under 35 U.S.C. 154(b) by 0 days.

(21) Appl. No.: 18/813,811

(22) Filed: Aug. 23, 2024

(65) Prior Publication Data

US 2026/0055764 A1 Feb. 26, 2026

(51) Int. Cl.
*F04C 18/02* (2006.01)
*F04C 29/12* (2006.01)

(52) U.S. Cl.
CPC ..... *F04C 18/0215* (2013.01); *F04C 29/126* (2013.01)

(58) Field of Classification Search
CPC ..... F04C 18/0215; F04C 29/126
See application file for complete search history.

(56) References Cited

U.S. PATENT DOCUMENTS

| | | | | |
|---|---|---|---|---|
| 11,221,008 | B2 | 1/2022 | Maeda et al. | |
| 11,254,190 | B2 | 2/2022 | He et al. | |
| 11,384,759 | B2 | 7/2022 | Bhatia et al. | |
| 11,867,174 | B2 * | 1/2024 | Lee | F04C 29/12 |
| 11,898,558 | B2 | 2/2024 | Lee et al. | |
| 12,006,938 | B1 | 6/2024 | Crenshaw et al. | |
| 12,098,719 | B2 | 9/2024 | Ganster et al. | |
| 2022/0389929 | A1 * | 12/2022 | Lee | F04C 29/042 |

FOREIGN PATENT DOCUMENTS

| | | | |
|---|---|---|---|
| JP | H11107948 | A | 4/1999 |
| JP | 2000329082 | A | 11/2000 |
| JP | 2015129476 | A | 7/2015 |
| JP | 7219827 | A | 1/2023 |

OTHER PUBLICATIONS

European Patent Office, Extended European Search Report of corresponding European Patent Application No. EP 25197716.1, dated Nov. 17, 2025, 7 pages.

* cited by examiner

*Primary Examiner* — J. T. Newton
(74) *Attorney, Agent, or Firm* — Valeo Japan Co., Ltd.

(57) ABSTRACT

A scroll compressor including: a housing; a motor arranged in the housing; a rotating shaft configured to be rotated by the motor; an orbital scroll configured to be orbitally moved by the rotating shaft; and a fixed scroll forming a compression chamber together with the orbital scroll. The housing includes a rear housing having a discharge chamber for accommodating a refrigerant discharged from the compression chamber, a discharge port guiding the refrigerant from the discharge chamber to an outside of the housing, an introduction port configured to receive an intermediate pressure refrigerant from outside of the housing, and an introduction chamber configured to accommodate the refrigerant introduced through the introduction port. The introduction chamber includes an injection valve assembly with a first check valve via which the injection valve assembly is communicated fluidically with the compression chamber.

20 Claims, 7 Drawing Sheets

COMPRESSOR

TECHNICAL FIELD

The present invention relates to a compressor for an air conditioning system for a vehicle, in particular to a scroll compressor.

BACKGROUND OF THE INVENTION

In general, a scroll compressor can include two spiral scrolls, where one is fixed and one is movable. The movable scroll can perform a revolving movement by being driven by an electric motor. The volume of the compression chamber formed by both scrolls then varies according to the revolution of the movable scroll. Both scrolls cooperate to compress the working fluid taken into the compression chamber defined between the spiral walls of the pair of scroll members. The compressed fluid then can be discharged from the compressor to the air conditioning system.

An air conditioning system can utilize a vapor injection cycle with an internal heat exchanger. In such case, the refrigerant from the outlet of the condenser can be separated into two paths. The first path is configured to go through an upper-stage expansion valve and subsequently enter the internal heat exchanger. In the internal heat exchanger, the refrigerant of the first path can provide subcooling to the refrigerant coming from the other path. The superheated vapor from the internal heat exchanger can be injected to the compressor, while the sub-cooled liquid can enter the lower-stage expansion valve, through the evaporator, and flow to the compressor suction.

It would be desirable to provide a cost effective way to inject the vapor to the compressor which would at the same time not compromise the efficiency of the whole system.

SUMMARY OF THE INVENTION

An object of the invention is a scroll compressor comprising: a housing; a motor arranged in the housing; a rotating shaft configured to be rotated by the motor; an orbital scroll configured to be orbitally moved by the rotating shaft; and a fixed scroll forming a compression chamber together with the orbital scroll, wherein the housing includes a rear housing having a discharge chamber for accommodating a refrigerant discharged from the compression chamber, a discharge port guiding the refrigerant from the discharge chamber to an outside of the housing, an introduction port configured to receive an intermediate pressure refrigerant from outside of the housing, and an introduction chamber configured to accommodate the refrigerant introduced through the introduction port, wherein the introduction chamber includes an injection valve assembly with a first check valve via which the injection valve assembly is communicated fluidically with the compression chamber.

Preferably, the injection valve assembly includes a second check valve via which the injection valve assembly is communicated fluidically with the compression chamber.

Preferably, the injection valve assembly includes an inlet arrangement configured to receive the refrigerant from the introduction chamber, the injection valve assembly being configured to split the refrigerant so that the refrigerant reaches the compression chamber through both the first check valve and the second check valve.

Preferably, the injection valve assembly includes a tray and a plate, the tray and the plate together forming a valve chamber for the refrigerant between the inlet arrangement and the first check valve.

Preferably, the tray includes a tray bottom and a tray side wall extending from the tray bottom towards the plate.

Preferably, the inlet arrangement includes a first side inlet and a second side inlet, both facing the introduction chamber and being configured to supply the refrigerant from the introduction chamber to the valve chamber.

Preferably, the inlet arrangement includes a first middle inlet and a second middle inlet for the refrigerant.

Preferably, the first middle inlet and the second middle inlet are arranged along a first straight line connecting the first side inlet and a second site inlet.

Preferably, outline of the plate at least matches outline of the tray.

Preferably, the introduction chamber is formed by a portion of the rear housing and the plate.

Preferably, the introduction chamber is formed by a rear base plate of the rear housing, a second wall protruding from the rear base plate, and the plate.

Preferably, the plate includes a plate enlargement extending beyond the outline of the tray, with the outline of the plate matching outline of the second wall.

Preferably, the introduction port terminates in the introduction chamber so that the incoming refrigerant will directly face the plate enlargement.

Preferably, the introduction port terminates in the introduction chamber in-between the first check valve and the second check valve when measured along a second straight line connecting the first check valve and the second check valve.

Preferably, the first check valve is accommodated in a first valve holder extending from the tray in a direction opposite to the introduction chamber.

Preferably, the second check valve is accommodated in a second valve holder extending from the tray in a direction opposite to the introduction chamber.

Preferably, the injection valve assembly is releasably connected to the rear housing.

Preferably, the injection valve assembly is releasably connected to the rear housing by a screw connection.

BRIEF DESCRIPTION OF DRAWINGS

The present invention will be described in greater detail below with reference to the drawings. In the drawings.

DETAILED DESCRIPTION OF THE INVENTION

Figure 1:
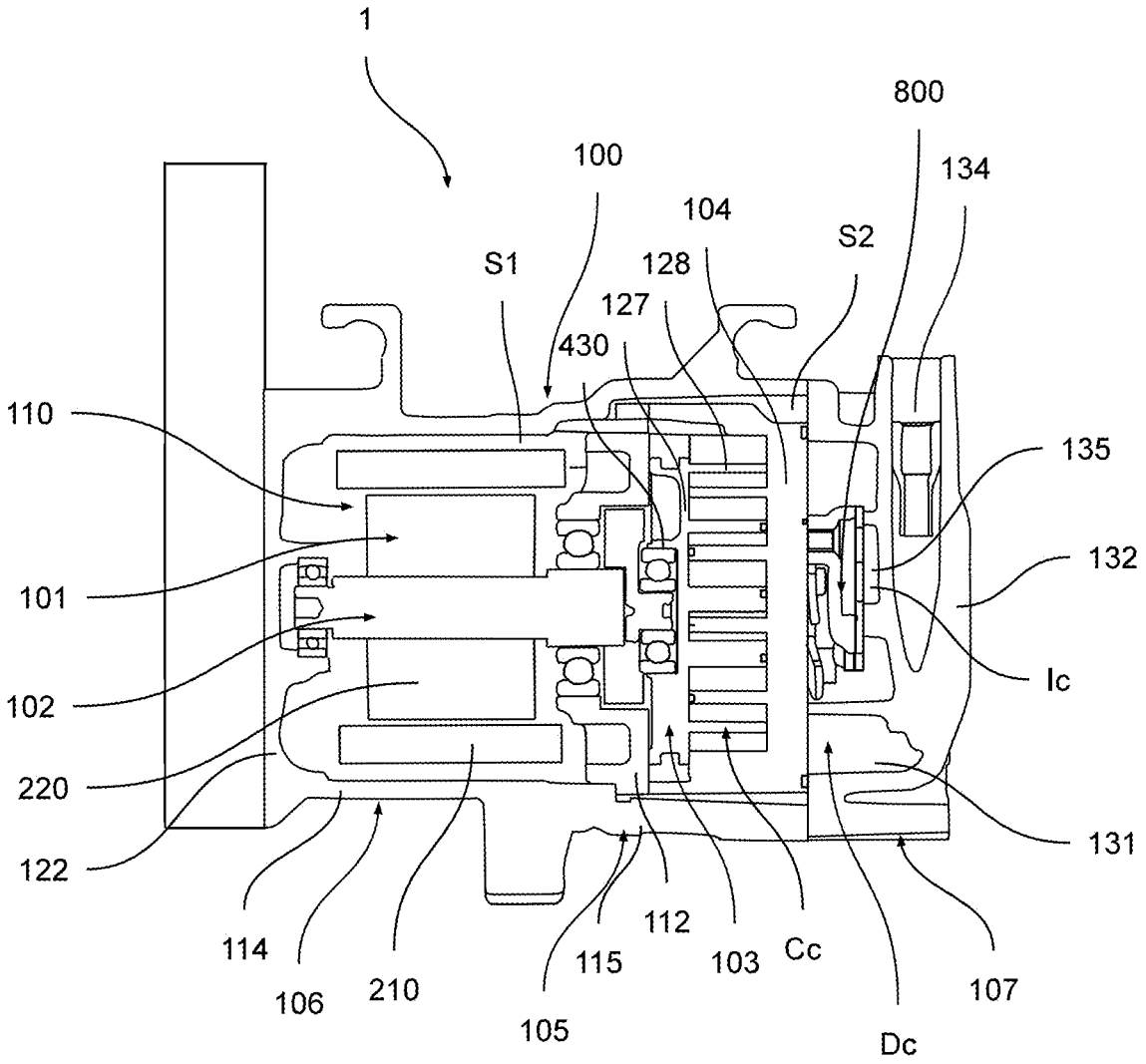
FIG. 1 is a cross-sectional view showing a scroll compressor according to the invention.

FIG. 1 is a cross-sectional view showing a scroll compressor 1 according to the invention. The scroll compressor 1 can include a housing 100, a motor 101 arranged inside the housing 100, a rotating shaft 102 rotated by the motor 101, an orbital scroll 103 moved by the rotating shaft 102, and a fixed scroll 104 forming a compression chamber Cc with the orbital scroll 103.

The scroll compressor 1 can further include an injection flow path to guide intermediate pressure refrigerant from an outside of the housing 100 into the compression chamber Cc. The scroll compressor 1 can include an injection valve assembly 800 for opening and closing the injection flow path.

The injection flow path is formed extending from a rear housing 107 to the fixed scroll 104 by including an introduction port 147, introduction chamber Ic, and the valve injection assembly 800. The injection valve assembly 800 can be interposed between the rear housing 107 and the fixed scroll 104.

The housing 100 can include a center housing 105, a front housing 106 and a rear housing 107. The rotating shaft 102 passes through the center housing 105. The front housing 106 together with the center housing 105 form a motor volume 110 in which the motor 101 is accommodated. The rear housing 107 together with the center housing 105 form a scroll volume 111 in which the orbital scroll 103 and the fixed scroll 104 are accommodated. The center housing 105 can include a center base plate 112, which separates the motor volume 110 from the scroll volume 111. The center base plate 112 supports the orbital scroll 103 and the fixed scroll 104. The center housing 105 can include a center sidewall 115 protruding from an outer periphery of the center base plate 112 to the front housing 106.

As shown in FIG. 1, the motor 101 can include a stator 108 fixed to the front sidewall 114 and a rotor 109 rotated by interaction with the stator 108 inside the stator 108.

The rotating shaft 102 is coupled to the rotor 109 and passes through a center of the rotor 109, and one end of the rotating shaft 102 passes through the shaft opening of the center base plate 112. The other end of the rotating shaft 102 can be supported on the front base plate 113.

The center base plate 112 has a substantially circular plate shape. A shaft opening through which one end of the rotating shaft 102 passes, and a back pressure chamber for pressing the orbital scroll 103 toward the fixed scroll 104 can be formed in the center of the center base plate 112. An eccentric bushing (not shown) for converting the rotational motion of the rotating shaft 102 into the orbital motion can be formed at one end of the rotating shaft 102. Space for rotation of the eccentric bush can be provided in the back pressure chamber. The center base plate 112, the center sidewall 115, the front base plate 113, and the front sidewall 114 can form the motor volume 110.

The front housing 106 can include a front base plate 113 facing the center base plate 112 and supporting the other end of the rotating shaft 102. The front housing 106 can include a front sidewall 114 protruding from an outer periphery of the front base plate 113, coupled to the center sidewall 115, and supporting the motor 101.

A suction flow path (not shown) guiding the refrigerant flowing into the motor volume 110 to the scroll volume 111 can be formed on the outer periphery of the center base plate 112. In particular, the refrigerant having a suction pressure can be introduced into the compression chamber Cc through the suction port (not shown), the motor volume 110, the suction flow path (not shown), and the scroll volume 111. A suction port (not shown) guiding a refrigerant having a suction pressure from an outside to the motor volume 110 can be formed, for example, on the front sidewall 114.

Figure 2:
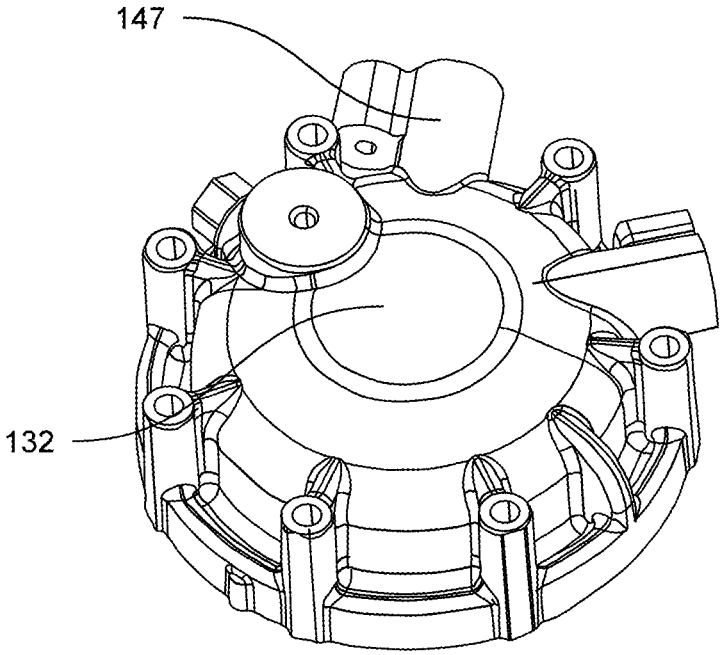
FIG. 2 is a perspective view of the rear housing from the top.
Figure 3:
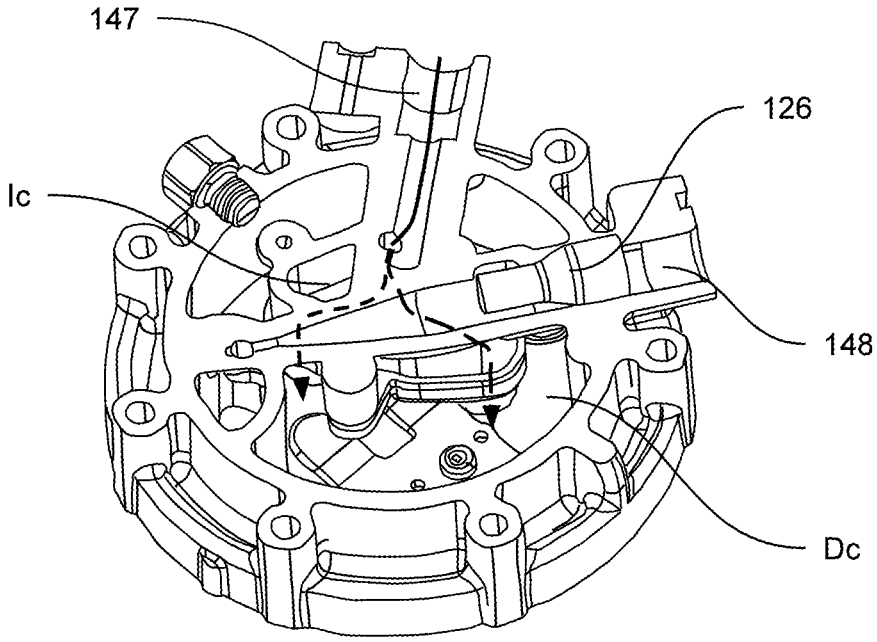
FIG. 3 is a first cross-sectional perspective view of the rear housing of FIG. 2.
Figure 4:
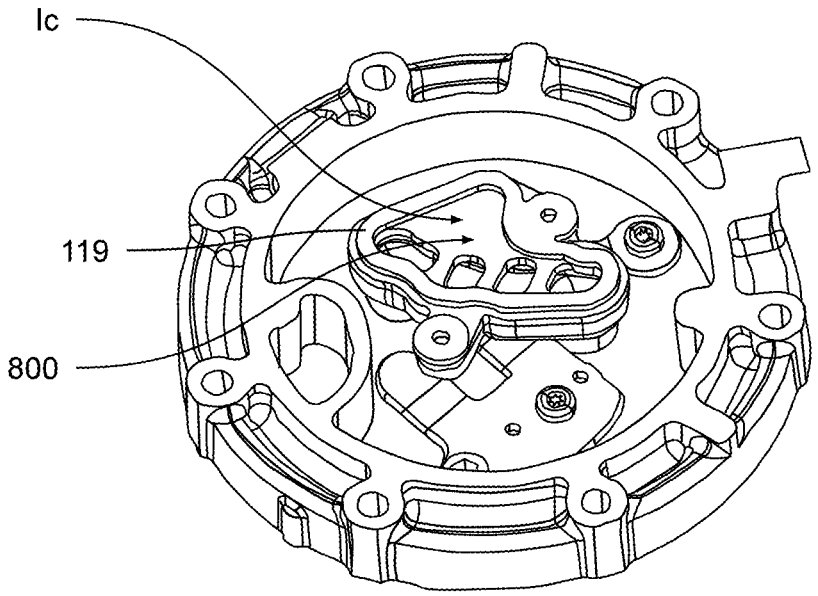
FIG. 4 is a second cross-sectional perspective view of the rear housing of FIG. 2.
Figure 5:
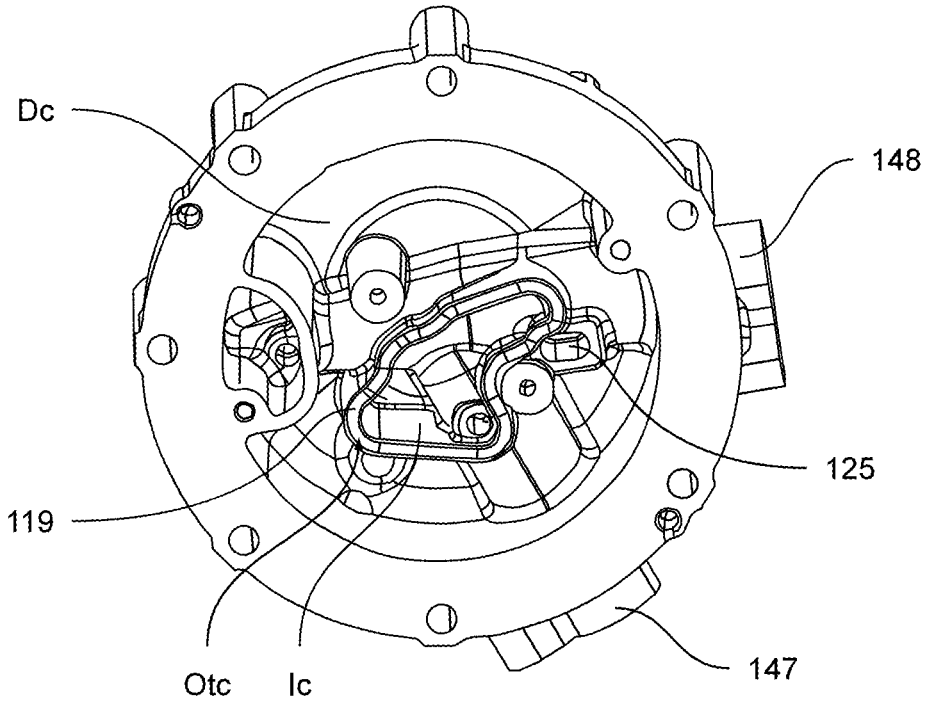
FIG. 5 is a perspective view of the rear housing from the bottom.
Figure 6:
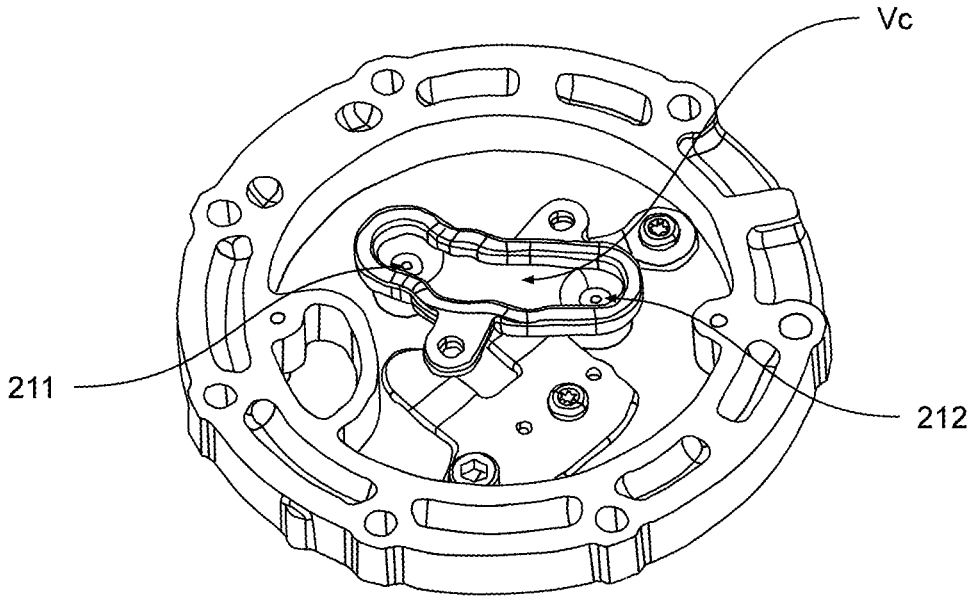
FIG. 6 is a third cross-sectional perspective view of the rear housing of FIG. 2.
Figure 7:
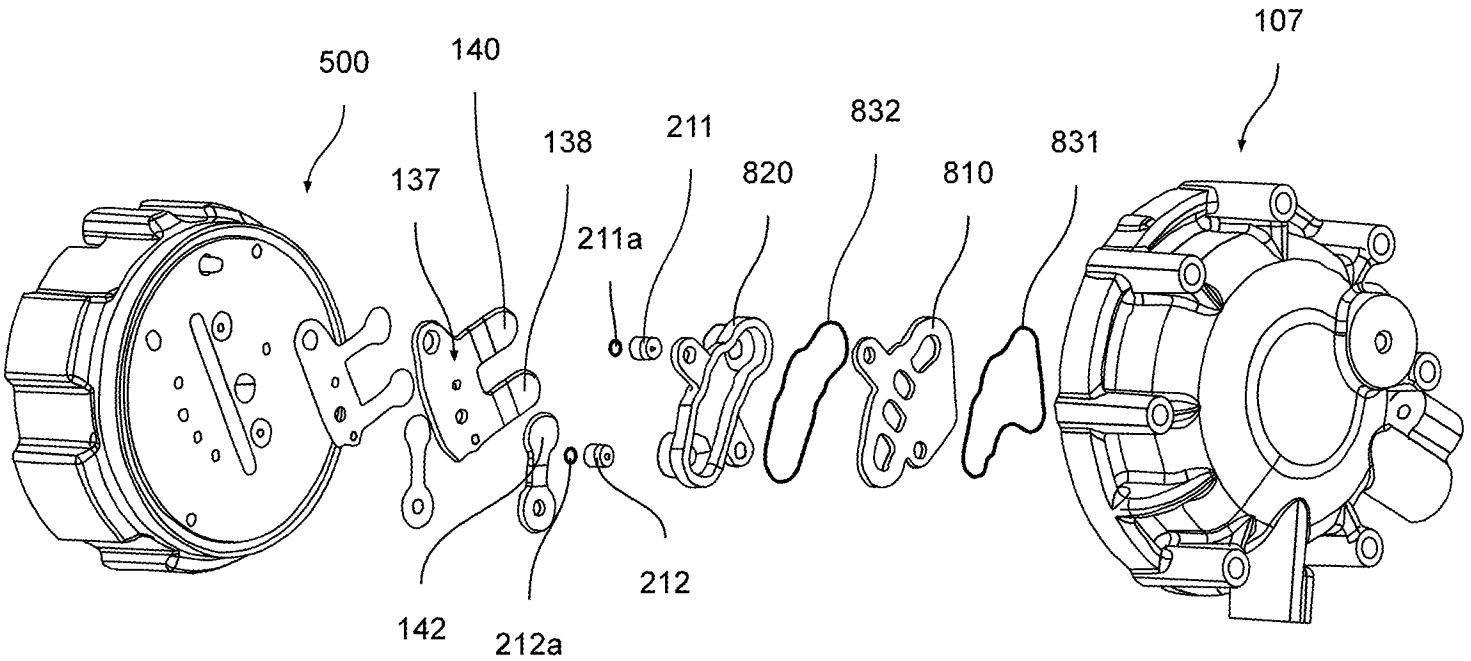
FIG. 7 is an exploded perspective view of the rear housing and the orbital scroll.
Figures 8A, 8B:
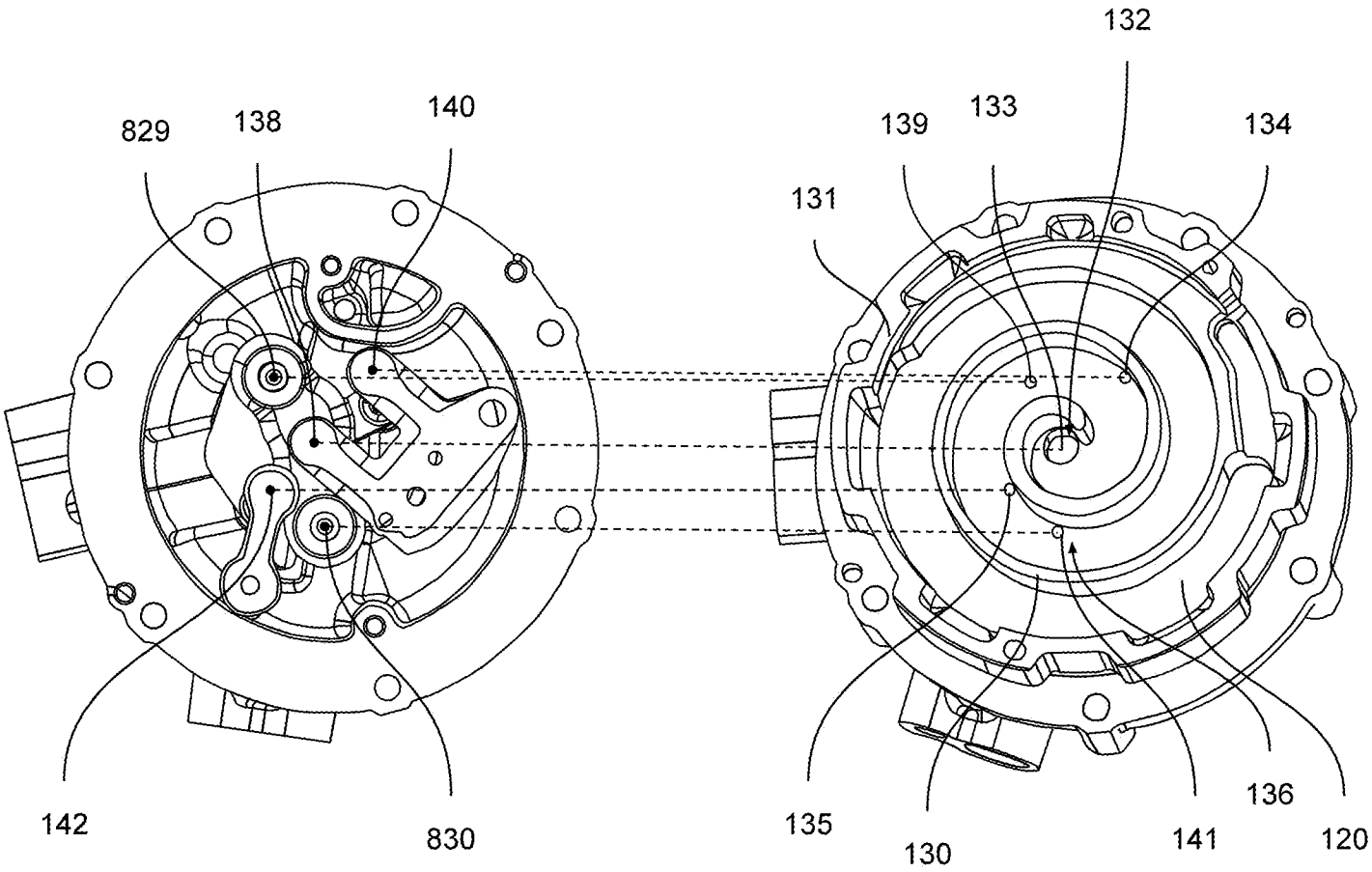
FIG. 8*a* is a view of the rear housing from the bottom.
FIG. 8*b* is a view of the orbital scroll from the top, with the rear housing behind.

The further aspects will be explained in relation to FIGS. 2-7, where FIG. 2 is a perspective view of the rear housing 107 from the top; FIG. 3 is a first cross-sectional perspective view of the rear housing 107 of FIG. 2; FIG. 4 is a second cross-sectional perspective view of the rear housing 107 of FIG. 2; FIG. 5 is a perspective view of the rear housing 107 from the bottom; FIG. 6 is a third cross-sectional perspective view of the rear housing 107 of FIG. 2; FIG. 7 is an exploded perspective view of the rear housing 107 and the orbital scroll 103; FIG. 8*a* is a view of the rear housing 107 from the bottom; and FIG. 8*b* is a view of the orbital scroll 103 from the top, with the rear housing 107 behind.

The rear housing 107 can include a discharge chamber Dc, a discharge port 148, an introduction port 147 and an introduction chamber Ic. The discharge chamber Dc can be configured for receiving the refrigerant discharged from the compression chamber Cc. The discharge port 148 can be configured for guiding the refrigerant from the discharge chamber Dc to the outside of the housing 100. Intermediate pressure refrigerant from the outside of the housing 100 can be introduced into introduction port 147 and then accommodated in the introduction chamber Ic.

The rear housing 107 can include a rear base plate 117, a first wall 118 and a second wall 119. The rear base plate 117 can be arranged opposite to the center base plate 112. The first wall 118 can protrude from the rear base plate 117 and be located at the outermost side in the circumferential direction of the rear housing 107. The second wall 119 can protrude from the rear base plate 117. The first wall 118 and the second wall 119 can be formed to have different heights.

The first wall 118 can form the scroll volume 111. The first wall 118 can be coupled to the outer periphery of the center base plate 112. The first wall 118 can be formed in an annular shape having a diameter approximately equal to that of the outer periphery of the center base plate 112.

The fixed scroll 104 can include a disk-shaped fixed base plate 120, a fixed wrap 130 and a fixed sidewall 131. The fixed wrap 130 can protrude from a center of the fixed base plate 120 and be engaged with an orbiting wrap 128 (described later). The fixed sidewall 131 can protrude from an outer periphery of the fixed base plate 120 and be coupled to the center base plate 112. The fixed sidewall 131 can be formed in an annular shape extending along the outer periphery of the fixed base plate 120.

The second wall 119 can be spaced apart from the fixed base plate 120. The second wall 119 can partially form the introduction chamber Ic.

The discharge port 148 can be formed in the rear base plate 117. The discharge port 148 can be formed to extend from a center of the rear base plate 117 to one side of an outer periphery of the rear base plate 117 in a radial direction of the rear base plate 117.

A discharge port inlet 125 guiding the refrigerant from the discharge chamber Dc to the discharge port 148 can be formed in the rear base plate 117.

A tubular oil separator 126 separating oil from refrigerant can be provided inside the discharge port 148. The oil separator 126 can be formed so that refrigerant is separated from oil during discharge process.

The introduction port 147 can be formed in the rear base plate 117. The introduction port 147 can be formed extending from the other side of the outer periphery of the rear base plate 117 to the center of the rear base plate 117 in the radial direction of the rear base plate 117, and can be communicated with the introduction chamber Ic.

The orbital scroll 103 can be interposed between the center base plate 112 and the fixed scroll 104. The orbital scroll 103 can include a disk-shaped orbiting base plate 127, the orbiting wrap 128 a boss portion 129. The orbiting wrap 128 can protrude from a center of the orbiting base plate 127 to the fixed scroll 104. The boss portion 129 can protrude from the center of the orbiting base plate 127 to the opposite side of the orbiting wrap 128 and be coupled to the eccentric bush.

The fixed base plate 120 can include a discharge hole arrangement 132 discharging the refrigerant of the compression chamber Cc to the discharge chamber Dc, and an injection hole arrangement 136 guiding the refrigerant discharged from the injection valve assembly 800 to the compression chamber Cc.

The discharge hole arrangement 132 can include a plurality of openings to prevent the refrigerant from being overcompressed. The discharge hole arrangement 132 can be opened and closed by a discharge valve 137 interposed between the fixed base plate 120 and the injection valve assembly 800.

The discharge hole arrangement 132 can include a main discharge hole 133, a first supporting discharge hole 134, and a second supporting discharge hole 135. The main discharge hole 133 can be formed in the center of the fixed base plate 120. The first supporting discharge hole 134 can be formed at a distance in a radial direction with respect to the main discharge hole 133. The second supporting discharge hole 135 can be formed at a distance in a radial direction with respect to the main discharge hole 133 and be formed on the opposite side of the first supporting discharge hole 134 with respect to the main discharge hole 133.

The discharge hole arrangement 132 in general is intended to discharge compressed refrigerant from the compression chamber Cc to the discharge chamber Dc. The compression chamber Cc can be divided into sub-chambers formed between the orbital scroll 103 and the fixed scroll 104.

In addition, the discharge valve 137 can include a main control portion 138 for opening and closing the main discharge hole 133, a first sub control portion 140 opening and closing the first supporting discharge hole 134, and a second sub control portion 142 opening and closing the second supporting discharge hole 135. The discharge valve 137 can be connected to the fixed base plate 510 by appropriate connection components (e.g. screws, not shown).

The injection hole arrangement 136 can include a first injection hole 139 and a second injection hole 141. The first injection hole 139 and the second injection hole 141 can be formed on opposite sides of each other with respect to an imaginary line connecting the first supporting discharge hole 134 and the second supporting discharge hole 135. Such an arrangement helps preventing pressure imbalance within the compression chamber Cc.

The fixed wrap 130 can be formed to extend, for example, in a logarithmic spiral from the central side of the fixed scroll 104 to the outer peripheral side of the fixed scroll 104.

The injection valve assembly 800 can be formed on the end surface of the second wall 119 to communicate and block between the introduction chamber Ic and the injection hole arrangement 136.

The injection valve assembly 800 is coupled to the rear housing 107. A first sealing member 831 and a second sealing member 832 can be interposed between relevant components to ensure fluid tightness.

When power is applied to the motor 101, the rotating shaft 102 can rotate together with the rotor 109. The orbital scroll 103 can be orbital moved by receiving the rotational force from the rotating shaft 102 through the eccentric bush. The volume of the compression chamber Cc can be reduced while continuously moving toward the center side.

The refrigerant sucked into the compression chamber Cc can be compressed while moving toward the center along a movement path of the compression chamber Cc and discharged to the discharge chamber Dc through the discharge hole arrangement 132.

The refrigerant of the discharge pressure discharged to the discharge chamber Dc can be discharged to the outside of the scroll compressor 1 through the discharge port 148.

Here, the scroll compressor 1 according to this embodiment includes the injection flow path (introduction port 147, introduction chamber Ic, injection valve assembly 800, injection hole arrangement 136) for guiding the intermediate pressure refrigerant to the compression chamber Cc, and compresses and discharges the refrigerant of suction pressure as well as the intermediate pressure refrigerant, so that the refrigerant discharge amount can be increased than when only the refrigerant of suction pressure is sucked, compressed and discharged. Thereby, the performance and efficiency of the scroll compressor 1 can be improved.

Figure 9:
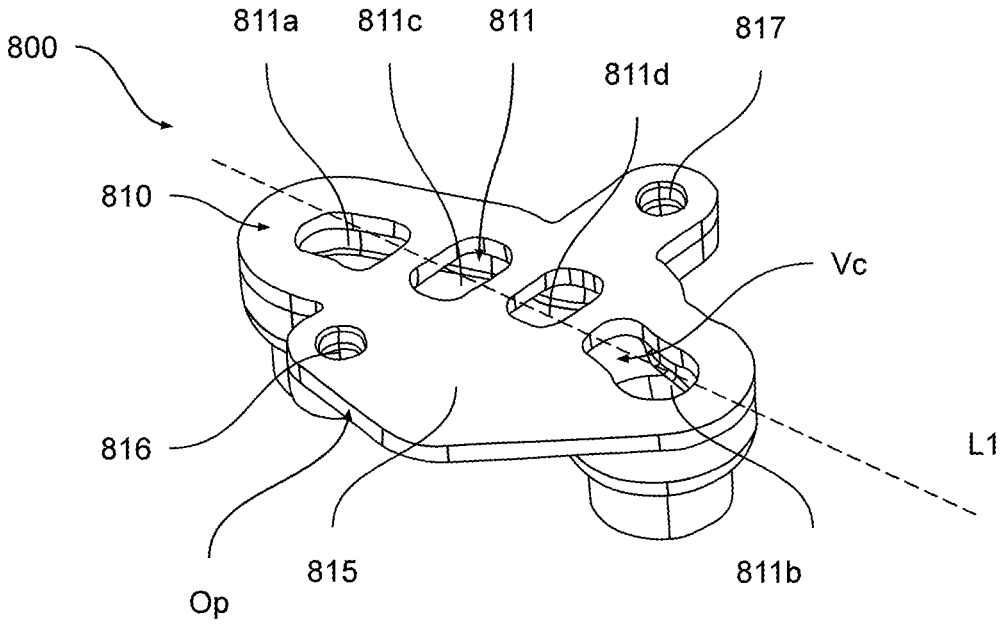
FIG. 9 is a perspective view of the valve injection assembly from the top.
Figure 10:
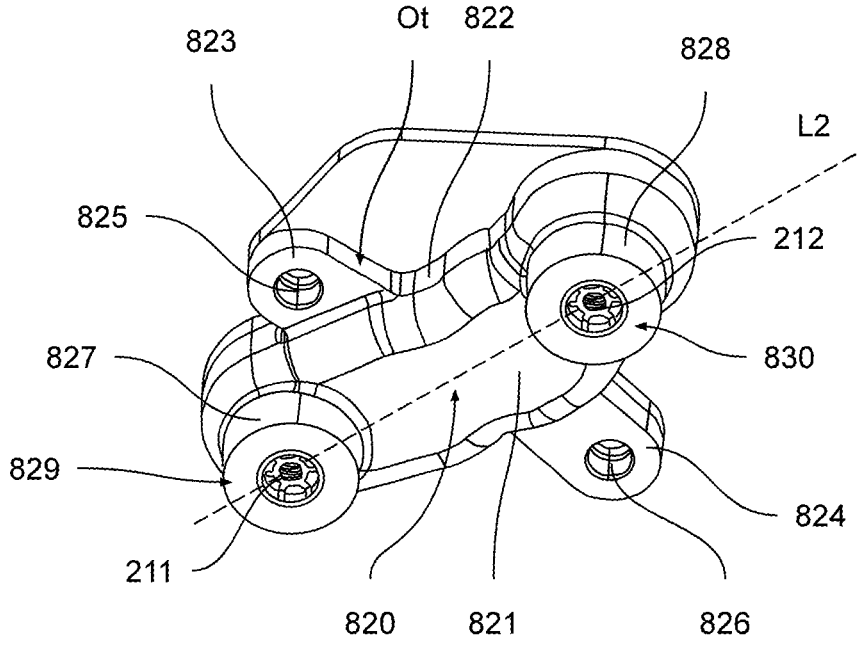
FIG. 10 is a perspective view of the valve injection assembly from the bottom.

FIG. 9 is a perspective view of the valve injection assembly 800 from the top, with FIG. 10 being a perspective view of the valve injection assembly 800 from the bottom.

The injection valve assembly 800 is attached to the rear housing 107 and is configured to receive the refrigerant from the introduction port 147.

The injection valve assembly 800 includes a first check valve 211 via which the injection valve assembly 800 is communicated fluidically with the compression chamber Cc. The refrigerant can be injected into the compression chamber Cc without the risk of the refrigerant escaping from the compression chamber Cc into the introduction chamber Ic. In other words, the first check valve 211 is configured to enable flow of the refrigerant from the introduction chamber Ic to the compression chamber Cc and to prevent flow of the refrigerant from the compression chamber Cc to the introduction chamber Ic.

In one example, a check valve 211, 212 can be configured by a cartridge valve composed of a valve element, spring, casing, and spring stopper.

The first check valve 211 can be arranged at a first outlet 829, which can face and be directly communicated with the first injection hole 139.

In one example, the injection valve assembly 800 includes a second check valve 212 via which the injection valve assembly 800 is communicated fluidically with the compression chamber Cc. Similarly to the first check valve 211, the refrigerant can be injected into the compression chamber Cc without the risk of the refrigerant escaping from the compression chamber Cc into the introduction chamber Ic. In other words, the second check valve 212 is configured to enable flow of the refrigerant from the introduction chamber Ic to the compression chamber Cc and to prevent flow of the refrigerant from the compression chamber Cc to the introduction chamber Ic.

The second check valve 212 can be arranged at a second outlet 830, which can face and be directly communicated with the second injection hole 141.

In order to ensure sealing a gap between the fixed scroll 104 and the injection valve assembly 800, respective O-rings 211*a*, 212*a* can be arranged around the first injection hole 139 and the second injection hole 141.

By providing two check valves 211, 212 cooperating to supply the compression chamber Cc with refrigerant, the supply can be carried out in a balanced way, for example symmetrically with respect to the main discharge hole 133 located at the center.

The injection valve assembly 800 can include an inlet arrangement 811 configured to receive the refrigerant from the introduction chamber Ic, the injection valve assembly 800 being configured to split the refrigerant so that the refrigerant reaches the compression chamber Cc through both the first check valve 211 and the second check valve 212.

In one example, the injection valve assembly 800 includes a tray 820 and a plate 810, the tray 820 and the plate 810 together forming a valve chamber Vc for the refrigerant between the inlet arrangement 811 and the first check valve 211 (and the second check valve 212 is it is present).

The tray 820 can include a tray bottom 821 and a tray side wall 822 extending from the tray bottom 821 towards the plate 810.

The plate 810 can include the inlet arrangement 811. In such case, the plate 810 is arranged to receive the refrigerant from the introduction chamber Ic, for example by contributing to forming of the introduction chamber Ic, for example by constituting one of its walls. The introduction chamber Ic can be formed by a portion of the rear housing 107 and the plate 810. The introduction chamber Ic can be formed by a rear base plate 117 of the rear housing 107 and a second wall 119 protruding from the rear base plate 117 and the plate 810.

The inlet arrangement 811 can include a first side inlet 811*a* and a second side inlet 811*b*, both facing the introduction chamber Ic and being configured to supply the refrigerant from the introduction chamber Ic to the valve chamber Vc.

The inlet arrangement 811 can include a first middle inlet 811*c* and a second middle inlet 811*d* for the refrigerant.

The first middle inlet 811*c* and the second middle inlet 811*d* can be arranged along a first straight line L1 connecting the first side inlet 811*a* and a second site inlet 811*b*. In one example, the first straight line L1 connects middles of the inlets.

In general, by providing a plurality of openings in the inlet arrangement 811 the refrigerant can be distributed to the valve chamber Vc in a more uniform manner, while maintaining the structural rigidity of the injection valve assembly 800.

In one example, outline of the plate Op can at least match outline of the tray Ot.

The plate 810 can include a plate enlargement 815 extending beyond the outline of the tray Ot, with the outline of the plate Op matching outline of the second wall Otc. Consequently, outline of the plate Op is larger than the outline of the tray Ot.

In general, the outlines Op, Ot, Otc are defined in planes perpendicular to a central extension axis of the scroll compressor 1, for example perpendicular to a rotation axis of the rotor 109.

The injection valve assembly 800 can be attached to the rear housing 107 by screws (not shown). The plate 810 can include a first plate fastening hole 816. The plate 810 can also include a second plate fastening hole 817. The tray 820 can include a first tray fastening arm 823 extending from the tray 820. The tray 820 can also include a second tray fastening arm 824 extending from the tray 820, for example in an opposite direction to the first tray fastening arm 823. The first tray fastening arm 823 can include a first tray fastening hole 825 for attaching the injection valve assembly 800 to the rear housing 107 in cooperation with the first plate fastening hole 816. The second tray fastening arm 824 can include a second tray fastening hole 826 for attaching the injection valve assembly 800 to the rear housing 107 in cooperation with the second plate fastening hole 817.

The introduction port 147 can terminate in the introduction chamber Ic so that the incoming refrigerant will directly face the plate enlargement 815.

The introduction port 147 can terminate in the introduction chamber Ic in-between the first check valve 211 and the second check valve 212 when measured along a second straight line L2 connecting the first check valve 211 and the second check valve 212. In one example, the second straight line L2 connects middles of check valves 211, 212.

The first check valve 211 can be accommodated in a first valve holder 827 extending from the tray 820 in a direction opposite to the introduction chamber Ic.

The second check valve 212 can be accommodated in a second valve holder 828 extending from the tray 820 in a direction opposite to the introduction chamber Ic.

The injection valve assembly 800 can be releasably connected to the rear housing 107. For example, the injection valve assembly 800 can be releasably connected to the rear housing 107 by a screw connection.

The invention claimed is:

1. A scroll compressor comprising:

a housing;

a motor arranged in the housing;

a rotating shaft configured to be rotated by the motor;

an orbital scroll configured to be orbitally moved by the rotating shaft; and a fixed scroll forming a compression chamber together with the orbital scroll, wherein the housing includes a rear housing having a discharge chamber for accommodating a refrigerant discharged from the compression chamber, a discharge port guiding the refrigerant from the discharge chamber to an outside of the housing, an introduction port configured to receive an intermediate pressure refrigerant from outside of the housing, and an introduction chamber configured to accommodate the refrigerant introduced through the introduction port, wherein the introduction chamber includes an injection valve assembly with a first check valve via which the injection valve assembly is communicated fluidically with the compression chamber;

wherein the injection valve assembly includes an inlet arrangement that includes a first middle inlet and a second middle inlet for the refrigerant.

2. The scroll compressor according to claim 1, wherein the injection valve assembly includes a second check valve via which the injection valve assembly is communicated fluidically with the compression chamber.

3. The scroll compressor according to claim 2, wherein the inlet arrangement is configured to receive the refrigerant from the introduction chamber, the injection valve assembly being configured to split the refrigerant so that the refrigerant reaches the compression chamber through both the first check valve and the second check valve.

4. The scroll compressor according to claim 1, wherein the injection valve assembly includes a tray and a plate, the tray and the plate together forming a valve chamber for the refrigerant between the inlet arrangement and the first check valve.

5. The scroll compressor according to claim 4, wherein the tray includes a tray bottom and a tray side wall extending from the tray bottom towards the plate.

6. The scroll compressor according to claim 3, wherein the inlet arrangement includes a first side inlet and a second side inlet, both facing the introduction chamber and being configured to supply the refrigerant from the introduction chamber to the valve chamber.

7. The scroll compressor according to claim 6, wherein the first middle inlet and the second middle inlet are arranged along a first straight line connecting the first side inlet and a second side inlet.

8. The scroll compressor according to claim 4, wherein an outline of the plate at least matches an outline of the tray.

9. The scroll compressor according to claim 4, wherein the introduction chamber is formed by a portion of the rear housing and the plate.

10. The scroll compressor according to claim 4, wherein the introduction chamber is formed by a rear base plate of the rear housing, a second wall protruding from the rear base plate, and the plate.

11. The scroll compressor according to claim 10, wherein the plate includes a plate enlargement extending beyond the outline of the tray, with the outline of the plate matching outline of the second wall.

12. The scroll compressor according to claim 11, wherein the introduction port terminates in the introduction chamber so that the incoming refrigerant will directly face the plate enlargement.

13. The scroll compressor according to claim 3, wherein the introduction port terminates in the introduction chamber in-between the first check valve and the second check valve when measured along a second straight line connecting the first check valve and the second check valve.

14. The scroll compressor according to claim 4, wherein the first check valve is accommodated in a first valve holder extending from the tray in a direction opposite to the introduction chamber.

15. The scroll compressor according to claim 4, wherein a second check valve is accommodated in a second valve holder extending from the tray in a direction opposite to the introduction chamber.

16. The scroll compressor according to claim 1, wherein the injection valve assembly is releasably connected to the rear housing.

17. The scroll compressor according to claim 1, wherein the injection valve assembly is releasably connected to the rear housing by a screw connection.

18. A scroll compressor comprising:

a housing;

a motor arranged in the housing;

a rotating shaft configured to be rotated by the motor;

an orbital scroll configured to be orbitally moved by the rotating shaft; and a fixed scroll forming a compression chamber together with the orbital scroll, wherein the housing includes a rear housing having a discharge chamber for accommodating a refrigerant discharged from the compression chamber, a discharge port guiding the refrigerant from the discharge chamber to an outside of the housing, an introduction port configured to receive an intermediate pressure refrigerant from outside of the housing, and an introduction chamber configured to accommodate the refrigerant introduced through the introduction port, wherein the introduction chamber includes:

an injection valve assembly with a first check valve and a second check valve via which the injection valve assembly is communicated fluidically with the compression chamber;

wherein the introduction port terminates in the introduction chamber in-between the first check valve and the second check valve when measured along a straight line connecting the first check valve and the second check valve.

19. The scroll compressor according to claim 18, wherein the injection valve assembly includes an inlet arrangement configured to receive the refrigerant from the introduction chamber, the injection valve assembly being configured to split the refrigerant so that the refrigerant reaches the compression chamber through both the first check valve and the second check valve.

20. A scroll compressor comprising:

a housing;

a motor arranged in the housing;

a rotating shaft configured to be rotated by the motor;

an orbital scroll configured to be orbitally moved by the rotating shaft; and a fixed scroll forming a compression chamber together with the orbital scroll, wherein the housing includes a rear housing having a discharge chamber for accommodating a refrigerant discharged from the compression chamber, a discharge port guiding the refrigerant from the discharge chamber to an outside of the housing, an introduction port configured to receive an intermediate pressure refrigerant from outside of the housing, and an introduction chamber configured to accommodate the refrigerant introduced through the introduction port, wherein the introduction chamber includes an injection valve assembly with a first check valve via which the injection valve assembly is communicated fluidically with the compression chamber;

wherein the injection valve assembly includes an inlet arrangement configured to receive the refrigerant from the introduction chamber, the injection valve assembly further including a tray and a plate, the tray and the plate forming a valve chamber; and wherein the first check valve is accommodated in a first valve holder extending from the tray in a direction opposite to the introduction chamber.

* * * * *